United States Patent [19]

Wolff

[11] Patent Number: 4,648,433

[45] Date of Patent: Mar. 10, 1987

[54] MILLING DEVICE

[76] Inventor: Robert Wolff, Im Kiesacker 12, 5446 Engeln, Fed. Rep. of Germany

[21] Appl. No.: 796,809

[22] Filed: Nov. 12, 1985

[30] Foreign Application Priority Data

Nov. 9, 1984 [DE] Fed. Rep. of Germany ..... 3440945

[51] Int. Cl.[4] ..... B27F 1/14; B27L 5/10

[52] U.S. Cl. ..... 144/144.5 GT; 144/87; 33/562; 409/130

[58] Field of Search ..... 409/130, 182; 144/144 R, 144.5, 82, 87, 83–85, 78; 33/562, 566, 567, 573

[56] References Cited

U.S. PATENT DOCUMENTS 4,074,736 2/1978 Wolff ..... 144/144.5

*Primary Examiner*—W. D. Bray

*Attorney, Agent, or Firm*—Antonelli, Terry & Wands

[57] ABSTRACT

A milling device for milling grooves into two boards to be joined together at right angles for comb-like wedge joints comprises a right-angled gauge with a supporting plate and a back plate. Both plates of the gauge are provided with slits in a comb-like way, with the slits passing in alignment into one another and being adapted to guide a guiding piece of the milling cutter. The supporting plate is provided at its free edge with projecting aligning fingers which are staggered with respect of the slits. By introducing the aligning fingers into the grooves of the first board, the second board can be exactly aligned for milling the corresponding wedges.

9 Claims, 12 Drawing Figures

10
12
12

12

III
9
1
6
4
5
III
21
7
13
12
IX
22
11
8
7
13
10
8
II
2
2
II
VII

MILLING DEVICE

BACKGROUND OF THE INVENTION

The invention relates to a device for milling grooves into boards which are to be pronged together at right angles for comb-like wedge joints by a milling cutter hand machine, with on the side of a workbench a right-angled gauge including a supporting plate and a back plate, and with—on the side of the milling cutter—a guiding piece, wherein both plates of the gauge are provided with slits in a comb-like way, the slits passing in alignment into one another in the reach of the corner edge of the gauge, and wherein the guiding piece is adapted to be guided by the slits of the gauge.

In the production of wooden furniture, bureau drawers, cases or the like, it is generally customary to assemble two boards abutting with their ends against each other at a right angle by a so-called wedge joint. For this purpose, several grooves are milled into the ends of each board, whereby the wedges developed between two adjacent grooves, must provide a cross-sectional shape which is congruent with the grooves. In the case of one of these boards, namely the so-called "cross-bar", the grooves must be oriented perpendiculary in relation to the plane of the board, while in the case of the other board, namely, the so called "longitudinal board", the run is parallel to its main surfaces. Further, the grooves and wedges in the case of one of the board must be displaced in a completely exact manner by always one half of the middle groove distance in relation to the grooves and wedges of the other board, so that the wedges of one board will fit into the respective grooves of the other board.

In West German Pat. No. 2,642,924, corresponding to U.S. Pat. No. 4,074,736, wedge joints of the aforementioned are milled by a hand operated milling cutter machine which includes on the side of a workbench of a right-angled gauge with a supporting plate and a back plate. Both plates are provided in a comb-like manner with slits passing in alignment into each other in an area of the corner edge of the plates. A guiding member, or the side of the milling cutter machine is guided in the slits of the gauge. By this milling cutter machine, it is possible to mill grooves into the cross bar and the longitudinal bar with the necessary precision of the relative position without extensive calculation and measuring; however the board, manufactured in a second place, must be clamped together with the gauge in such a way that it is displaced by exactly one half of the middle groove distance, if the two boards are to be assembled with flush edges. This clamping of the second board still needs certain aligning efforts and does not exclude the possibility of incorrectnesses.

The aim or object underlying the present invention essentially resides in providing a milling device for ensuring a correct alignment of the second board in a fool-proof manner.

A further object of the present invention resides in providing a milling device for an exact manufacturing of wedge joints of boards with flush edges or displaced edges as well.

Another object of the present invention resides in providing a milling device for manufacturing exact wedge joints for small boards or large boards.

A still further object of the present invention resides in providing a milling device adapted to mill dovetail grooves or rectangular grooves.

In accordance with advantageous features of the invention, the supporting plate of the gauge is provided at a free edge thereof, opposite to a corner edge of the plates, with at least one projecting aligning finger which is staggered with respect to said slits so that it is aligned with a prong remaining between two of the slits, whereat the cross-section of the aligning finger is adapted to the outline of the grooves which are to be milled.

As a result of achieving the object of the invention, a number of advantages will be achieved. First, the grooves of the longitudinal bar can be manufactured by the milling device in a conventional way. Then, this first board is turned upside down and put with its groove side and with flush edges, or, if desired with displaced edges, on the second board. The alignment of the gauge for milling the transverse grooves of the second board is now achieved by introducing the alignment finger into a groove of the first board. In this way, the exact relative positioning of grooves and wedges of the two boards is achieved without time consuming measuring and complicated aligning efforts and with regard to the desired relative position of the edges of the boards.

According to a preferred embodiment of the invention, the two aligning fingers are arranged in the middle of the supporting plate, the distance between the center lines thereof being equal to the distance between the center lines of the adjacent slits.

Further advantageous embodiments of the invention will be seen from the following description and attached drawings.

BRIEF DESCRIPTION OF THE DRAWING

The milling device of the invention will be explained in more detail on the basis of a first preferred embodiment and a second alternative embodiment shown in the drawings, wherein.

DETAILED DESCRIPTION

Figures 1, 2, 3:
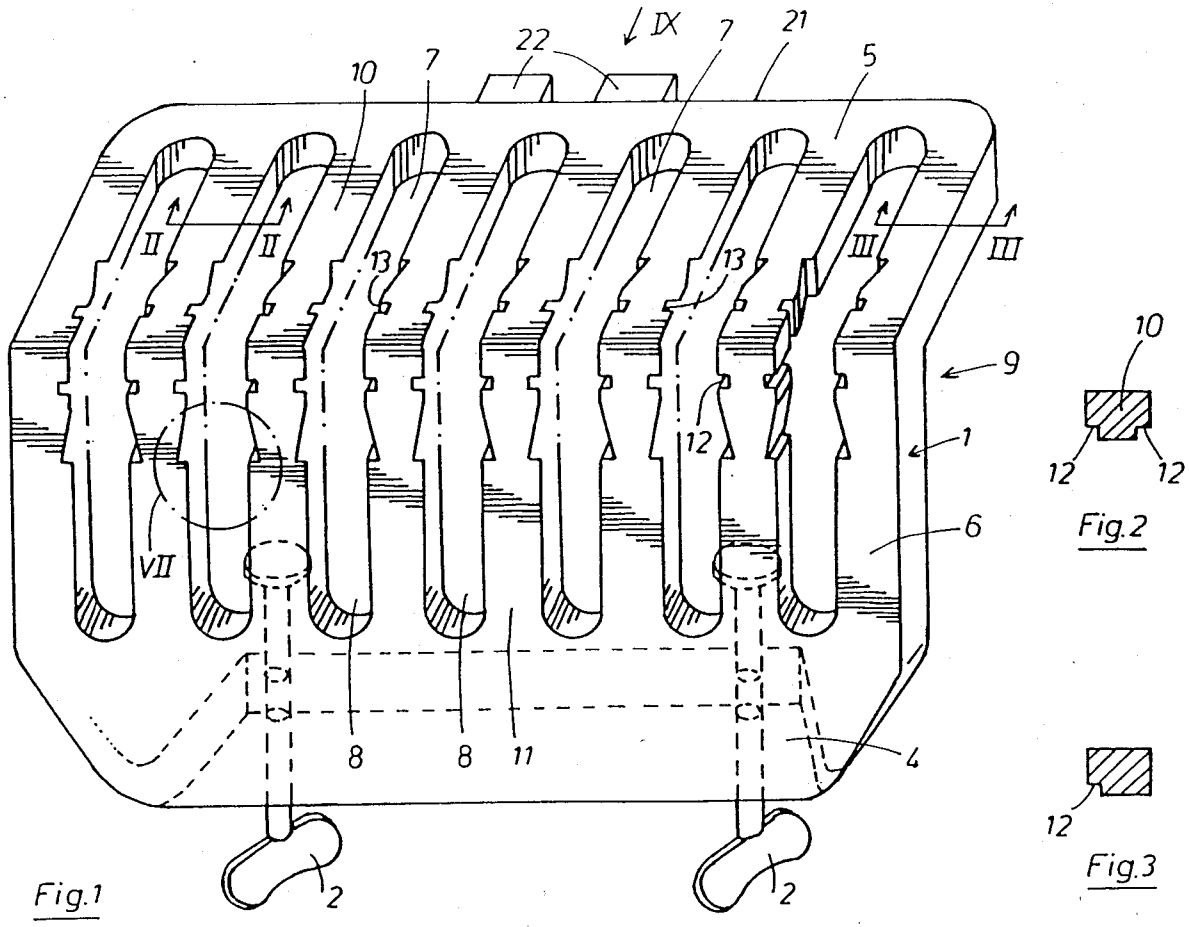
FIG. 1 is a perspective view of the gauge of the milling device according to the invention.
FIG. 2 is a cross-sectional view of a prong of the gauge taken along the line II—II in FIG. 1.
FIG. 3 is a cross-sectional view of a border-prong of the gauge taken along the line III—III in FIG. 1.
Figure 4:
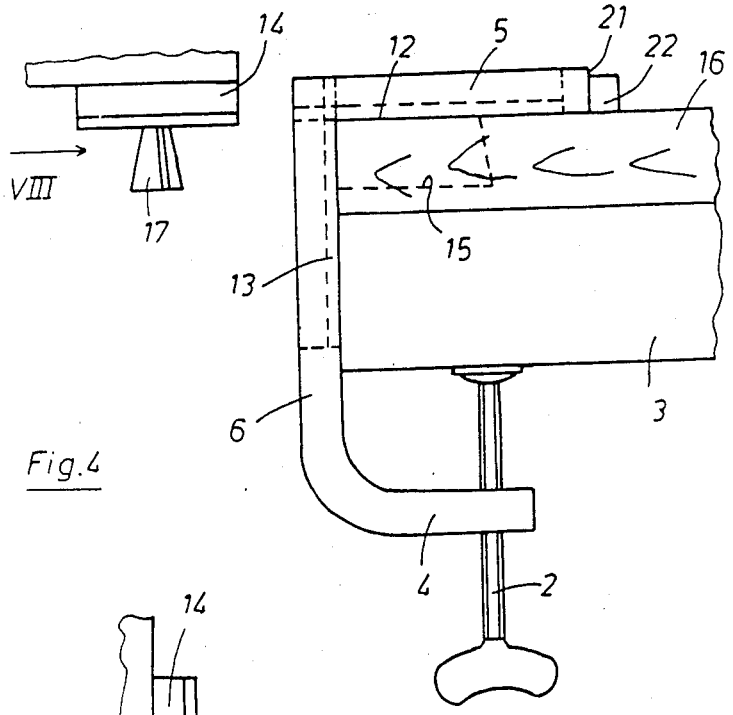
FIG. 4 shows the milling device on milling of a longitudinal bar.

Referring now to the drawings where like reference numerals are used throughout the various views to designate like parts and, more particularly, to FIGS. 1 and 4, according to these figures, a 1 of a device for milling grooves into boards which are to be pronged together at right angles for comb-like wedge joints has basic form of an U-shaped clamp which can be clamped by two clamping screws 2, on a workbench 3 or the like. The gauge 1 comprises a clamping leg 4 for the clamping screws 2, a supporting plate 5 and a back plate 6, with the plates 5, 6 being orientated orthogonally to each other. Both plates 5, 6 are provided in a comb-like way with slits 7, 8 passing in alignment into one another in an area of the corner edge 9 of the plates 5, 6. Prongs 10, 11 remaining between the slit 7, 8 also pass in alignment with one another, with the prongs 10, 11 having the same breadth as the slits 7, 8.

The prongs 10, 11 are provided with angular slots 12, 13 at their longitudinal borders on the side of the workbench 3, with the slots serving as a guide for a T-shaped guiding piece 14 on the side of the milling tool as shown in FIGS. 2–5. In FIG. 1, the angular slots 12, 13 are indicated only at the faces of the plates 5, 6 for the sake of clarity.

FIG. 4 shows a first working step for the milling of longitudinal grooves 15 into a first board 16 for a longitudinal bar, by for example, an endmilling cutter 17 shaped, for example, as a truncated cone, with the end milling cutter 17 being introduced by the guiding piece 14 into a slit 7 of the supporting plate 5 in a horizontal direction.

Figure 5:
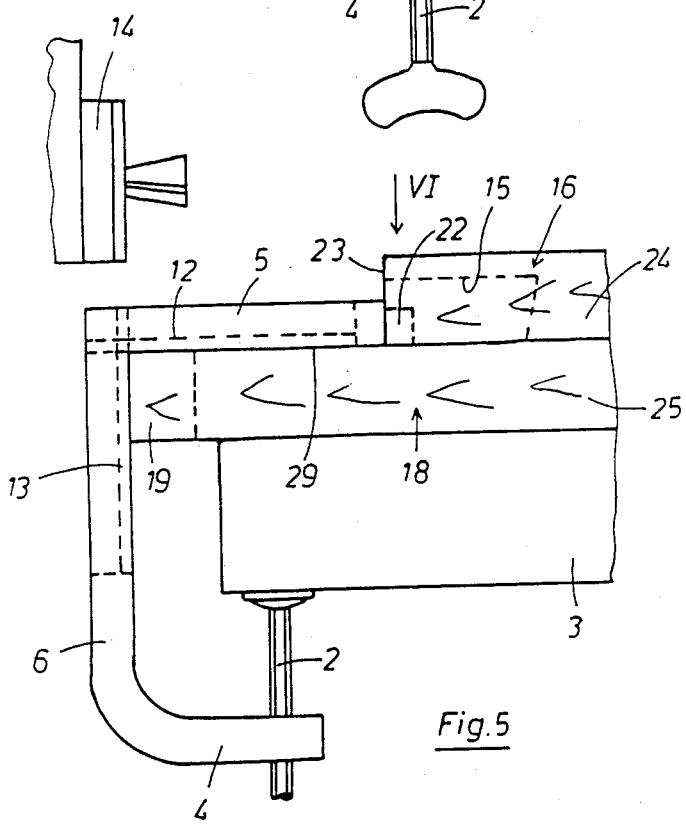
FIG. 5 shows the milling device on milling a cross bar.
Figure 6:
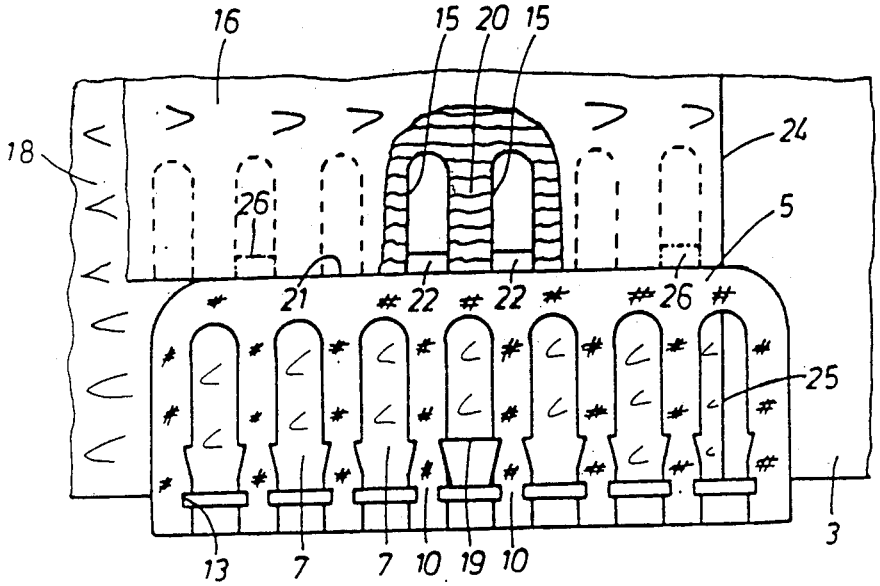
FIG. 6 is a planned view of the gauge taken in the direction of the arrow VI in FIG. 5.

At a second working step according to FIGS. 5 and 6, a second board 18, forming the cross bar, is provided with transverse grooves 19. For achieving an exact positioning of the transverse grooves 19 relatively to the prongs 20 remaining between the longitudinal grooves 15 of the first board 16, the supporting plate 5 of the gauge 1 is provided with two aligning fingers 22 at its edge 21 opposite to the corner edge 9. The aligning fingers 22 project in parallel with the direction of the slits 7 of the supporting plate 5 and are staggered so that they are each aligned with a prong 10 separating two slits 7.

Then the first board 16 is turned upside down and put with its groove side on the second board 18. Thereafter the two aligning fingers 22 are introduced into front openings of the longitudinal grooves 15 of the first board 16 so far that there is a flush abutment between the front border 23 of the first board 16 and the free edge 21 of the supporting plate 5. Both of the boards 16, 18 are now alinged with flush side borders 24, 25 to each other. Then the second board 18 can be clamped on the workbench 3 by means of the gauge 1 wherein there is, in a vertical direction, an exact alignment of the transverse grooves 19 which are to be milled.

The two aligning fingers 22 are arranged in the middle of the supporting plate 5, whereat the distance between their center lines is equal to the distance between the center lines of the adjacent slits 7. In this way, there is a good guidance, even if edge joints of very narrow boards are manufactured. For an improvement of the alignment of the first board 16 and the gauge 1 in case of very board boards, the free edge 21 can be provided at the outer areas of the supporting plate 5 with further aligning fingers 26 indicated by a dot-dash line.

Figure 7:
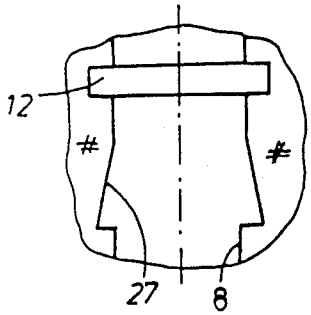
FIG. 7 is a partial view of the gauge according to a sector VII in FIG. 1.
Figure 8:
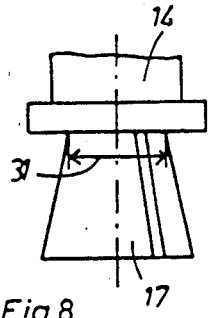
FIG. 8 shows an end milling cutter shaped as a truncated cone and adapted to the milling device according the direction of the arrow VIII in FIG. 4.
Figure 9:
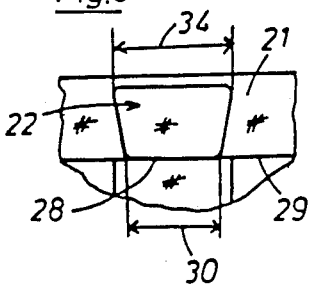
FIG. 9 shows an aligning finger of the milling device taken in the direction of the arrow IX in FIG. 1.

FIG. 7 shows a portion in the reach of a slit 8 of the back plate 6, the slit 8 being provided with an enlarged, trapezohedral passage 27 for the endmilling cutter 17 shaped like a truncated cone, (FIG. 8). By means of such cutters, dovetail grooves can be milled. The cross-section of the aligning fingers 22 are adapted to this outline, as shown in FIG. 9. That is that the aligning finger 22 has a trapezohedral cross-section, wherein the smller basis 28, adapted to the reversed first board 16, is flush with the supporting surface 29 of the supporting plate 5. The length 30 of the smaller basis 28 of the trapeze corresponds to the smallest diameter 31 of the cutter 17 shaped like a truncated cone.

Figure 10:
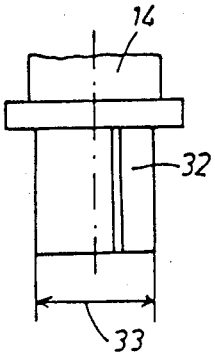
FIG. 10 shows a cylindrical end milling cutter in an analogous way to FIG. 8.

The embodiments of the passage 27 and of the aligning fingers 22 render possible the use of a cylindrical endmilling cutter 32 according to FIG. 10, whereat only the diameter 33 of the cutter 32 has to be equal to the length of the large basis 34 of the aligning fingers 22.

Figure 11:
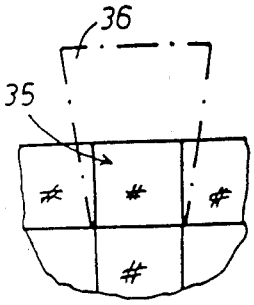
FIG. 11 shows a second embodiment of an aligning finger in an analogous way to FIG. 9.

FIG. 11 shows a second embodiment of an aligning finger 34 with a rectangular cross-section, with the finger being adapted first of all to rectangular grooves, of course. In principle, thereby, an alignment to dovetail grooves 36, respectively to a cutter shaped like a truncated cone, is possible, too, if the breadth of the aligning finger 35 corresponds to the smallest part of the opening of those grooves 36.

Figure 12:
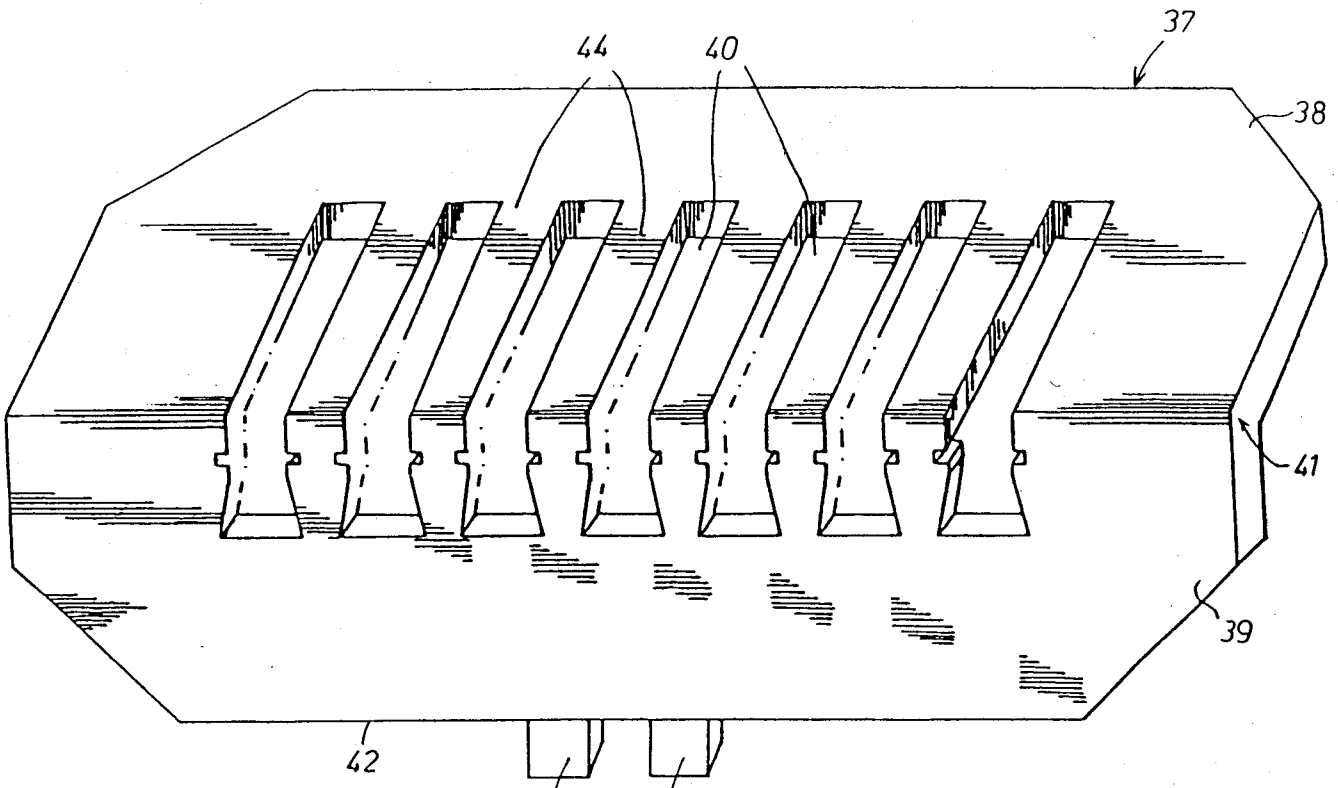
FIG. 12 shows a further embodiment of a gauge of the present invention.

FIG. 12 shows a further embodiment of a gauge 37 of a device for milling grooves for comb-like wedge joints. The gauge 37 comprises a guiding plate 38 and an aligning plate 39, with the plates 38, 39 being orientated orthogonally to each other. On the analogy of the supporting plate 5 or the back plate 6 of FIG. 1, the guiding plate 38 is provided with slits 40 in a comb-like way, with the slits 40 crossing the aligning plate 39. The aligning plate 39 has no slits, but it is provided at its free edge 42, opposite to the corner edge 41, with two aligning fingers 43, which project orthogonally with respect to the extension of the slits 40 of the guiding plate 38. The aligning fingers 43 are staggered with respect to the slits 40 so that they are respectively aligned with a prong 44 remaining between two of the slits 40. The cross sections of the aligning fingers 43 are adapted to the outline of the grooves 15 which are to be milled. By means of the gauge 37, longitudinal grooves 15 can be milled into a first board at a first working step analogous to FIG. 4. For this purpose, the guiding plate 38 is put on the first board 16 and the gauge 37 is clamped to the workbench 3 by means of a screw clamp or the like (not shown).

At a second working step analogous to the FIGS. 5 and 6, the transverse grooves 19 of a second board 18 can be milled. Therefor, the aligning plate 39 is put on the second board 18, whereas, the guiding plate 38 is arranged in a vertical position in front of the workbench with the slits orientated downwardly. Thereafter, the aligning fingers 43 are introduced into the front openings of the grooves 15 of the first board 16 put with its groove side on the second board 18. Thus, the gauge 37 is exactly aligned for the milling of the transverse grooves 19 and can be clamped to the workbench 3.

I claim:

1. A gauge for guiding a milling cutter into boards which are to be joined together at right angles by comb-like wedge joints, the gauge comprising a supporting plate means adapted to be mounted on a workbench, a back plate means joined by a corner area to said supporting plate means and disposed substantially at a right angle thereto, a plurality of spaced parallel slit means provided in said supporting plate means and said back plate means for receiving the milling cutter, with respective slit means in the respective plate means being in alignment with each other in the corner area, means provided in each of said slit means for guiding a guiding means of the milling cutter, at least one projecting aligning finger means provided at a free edge of said supporting plate means, said at least one projecting aligning finger means being aligned with a portion of the supporting plate means between two adjacent slit means, and wherein a cross-section of said at least one projecting aligning finger means is adapted to outline the grooves to be milled.

2. A gauge as claimed in claim 1, wherein at least two aligning finger means are provided and are disposed in a central area of the supporting plate means, and wherein a distance between center lines of the two aligning finger means is equal to a distance between center lines of two adjacent slit means.

3. A gauge as claimed in claim 2, wherein at least one further aligning finger means is provided at an outer area of the supporting plate means.

4. A gauge as claimed in claim 1, wherein the aligning finger means have a trapezohedral cross-section including a large base portion and a small base portion, and wherein the small base portion is adapted to be disposed flush with a supporting surface of the supporting plate means.

5. A gauge as claimed in claim 4, wherein the large base portion of the aligning finger means has a length sufficient to accommodate a diameter of a cylindrical endmilling cutter corresponding to the trapezohedral cross-section of the aligning finger means.

6. A gauge as claimed in claim 1, wherein the aligning means has a rectangle cross-sectional configuration.

7. A gauge as claimed in claim 6, wherein a breadth of the rectangular cross-sectional shaped aligning finger means is equal to a smallest diameter of an endmilling cutter shaped as a truncated cone.

8. A gauge as claimed in claim 2, wherein at least two further aligning finger means are provided at out areas of the supporting plate means.

9. A gauge for guiding a milling cutter into boards which are to be joined together at right angles by comb-like wedge joints, the gauge comprising a guiding plate, an aligning plate joined by a corner area to said guiding plate, a plurality of spaced parallel slit means extending across the aligning plate and the guiding plate for guiding a guiding piece of the milling cutter, at least one aligning finger means provided at a free edge of the aligning plate said at least one aligning finger means projecting orthogonally with respect to an extension of the slit means of the guiding plate, said at least one aligning finger means being disposed so as to be aligned with a portion of the aligning plate remaining between two adjacent slit means, and wherein a cross-section of the at least one aligning finger means is adapted to an outline of grooves to be milled.

* * * * *